US006290222B1

(12) United States Patent
Matthaus

(10) Patent No.: US 6,290,222 B1
(45) Date of Patent: Sep. 18, 2001

(54) SHEET FEED TABLE

(75) Inventor: Wolfgang Matthaus, Offenbach (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/489,323

(22) Filed: Jan. 21, 2000

(30) Foreign Application Priority Data

Jan. 21, 1999 (DE) ..... 299 00 995

(51) Int. Cl.[7] ..... B65H 5/00
(52) U.S. Cl. ..... 271/10.01; 271/225; 271/264
(58) Field of Search ..... 271/10.01, 12, 271/10.07, 10.1, 10.15, 225, 264, 273, 275, 184

(56) References Cited

U.S. PATENT DOCUMENTS 843,709 * 2/1907 Slack et al. ..... 271/275
3,932,982 * 1/1976 Klapp ..... 271/184
5,295,675 * 3/1994 Hain ..... 271/12
5,362,037 * 11/1994 Werff et al. ..... 271/10.1

FOREIGN PATENT DOCUMENTS

196460 * 4/1907 (DE) ..... 271/275
297 10 296 U1 11/1998 (DE) .

* cited by examiner

*Primary Examiner*—H. Grant Skaggs
(74) *Attorney, Agent, or Firm*—Leydig, Voit & Mayer, Ltd.

(57) ABSTRACT

A sheet feed table for receiving sheets along a substantially horizontal sheet feed plane and for transferring the sheets to a sheet processing machine. The sheet feed table has a sheet transfer table surface inclined at an angle with respect to the sheet feed plane, and at least one relatively positionable guide roller device is mounted above a turn point between the sheet feed plane and the table surface. The guide roller device includes a plurality of deflection rollers arranged in a curved array which extends from a position approximately tangential to the sheet feed plane to a position approximately tangential to the table surface for directing the sheets along a curved path onto the inclined table surface.

6 Claims, 1 Drawing Sheet

SHEET FEED TABLE

FIELD OF THE INVENTION

The present invention relates generally to feed tables for feeding sheets to sheet processing machines, such as printing presses, and more particularly, to a feed table having a table surface that is inclined with respect to the sheet feed plane.

BACKGROUND OF THE INVENTION

It is known to use a pair of roller deflection devices above a feed table in order to deflect sheets to be conveyed, each roller deflection device having individual deflection rollers arranged one behind the other in the conveying direction on a common support. In that arrangement, the individual deflection roller which is at the rear in the conveying direction is driven so as to rotate the individual deflection roller which is at the front in the conveying direction. In addition, the pair of roller deflector devices are installed in a fixed position relative to the feed table. As a result, a change in the quality or type of sheets to be processed requires at least some rebuilding of the installation in order to adapt the pair of roller deflection devices to the different conditions. In addition, the roller deflection devices are complicated, as a result of the drive to the individual deflection rollers, and have a very short deflection range defined by only two deflection points.

It is further known from German Patent DE 29710296 to adjustably position a pair of roller deflection devices by means of a pneumatic cylinder. In this case, the incoming sheet can be more reliably deflected, but can be delayed as a result of a non-positive loading or drive to the rollers. There is a risk therefore, that the sheets cannot be fed correctly to the sheet processing machine.

OBJECTS AND SUMMARY OF THE INVENTION

It is an object of the present invention to provide a sheet feed table which, without the application of driving forces to the rollers, is operable for reliably processing a wide range of sheets, including very stiff sheets, to an inclined sheet feed table for reliable onward transport.

According to the invention, this object is achieved by providing a plurality of roller deflection devices which are adjustably mounted above the feed table and which have a plurality of deflection rollers arranged in the direction run out in the form of a curve approximately tangential to the plane of the feed table. This design enables easy and automatic adjustment of the distance of the roller deflection device above the feed table, as well as its deflection path, for the particular material being processed and for the stiffness of the sheets being processed. It is preferable that the individual deflector rollers be mounted for free rotation, without a positive drive, for preventing abrasion marks on the sheets by the deflection rollers.

A simple design of roller deflection device is achieved by providing relatively slim profiled deflector wheels along the length of the free end of a holder, the height and position of which can be selectively adjusted. Guidance of the sheets over a relatively long distance is achieved and flicking up of the trailing ends of the sheets is substantially avoided if a plurality of such deflection wheels are arranged one behind another in the conveying direction, with each deflection wheel preferably being mounted to rotate freely. The deflection wheels may be arranged at spaced intervals to each other and on opposite sides of the holder, which acts as a common support, with contours of the deflection wheels on one side of the holder overlapping contours of the deflection wheels on the opposite side. With such arrangement, it is possible to ensure reliable contact between each sheet and the deflection wheels so as to redirect the sheets onto the feed table or onto a conveyor tape guided over the feed table. Reliable deflection of the sheets onto the feed table is further enhanced by utilization of a plurality of such roller deflection devices arranged in side-by-side relation to one another at intervals transversely with respect to the conveying direction.

Other objects and advantages of the invention will become apparent upon reading the following detailed description and upon reference to the drawings, in which:

Figure 1:
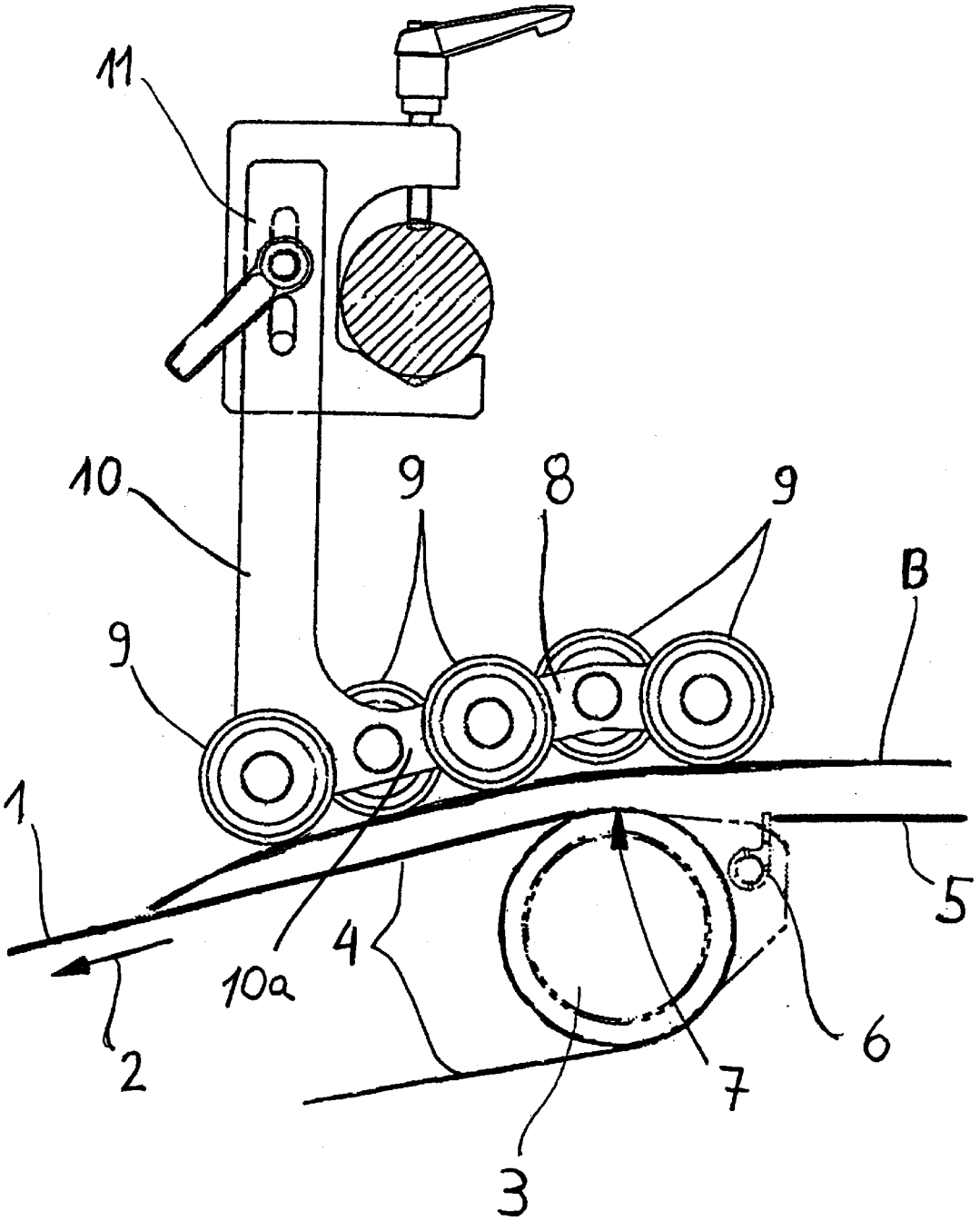
FIG. 1 is a partially diagrammatical depiction of a sheet feed table embodying the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to FIG. 1 of the drawing, there is shown an illustrative feed table embodying the present invention having a table surface 1 inclined downwardly to the horizontal in the conveying direction 2. The illustrated feed table comprises endless conveyor tapes 4 trained over tape rolls 3. As will be understood by one skilled in the art, the conveyor tapes 4 can be driven by one of the tape rolls 3 for transporting sheets B in the conveying direction to a downstream sheet processing machine, such as a printing press.

The sheets B at the higher, upstream end of the feed table are fed horizontally above a surface forming a substantially horizontal feed plane 5 from a sheet stack of a sheet feeder of a conventional type. On the upstream or feed side of the feed table, tiltable stops 6 are provided, which as known in the art, are operable for successfully releasing the sheets from the sheet stack onto the tape rolls 3. Movement of the sheet onto the feed table can be effected by conventional conveying rollers which can be cyclically brought into contact with the tape roll 3. The sheet B is effectively clamped between the tape roll 3 and the conveying rollers and is moved forwardly by rotation of the tape roller 3. Preferably the conveying rollers act only in point-by-point fashion along the tape roll 3. Alternatively, an additional conveying roll may be arranged upstream of the tape roll 3 for interaction with conveying rollers to feed sheets B from the sheet feeder onto the inclined feed table over a bridging plane of the tape roll 3, which forms the feed plane 5.

In accordance with the invention, at least one guide roller device is provided above the juncture or turn point between the sheet feed plane and the plane of the table which comprises a plurality of deflection rollers arranged in the form of a curve for reliably contacting and guiding the sheets from their horizontal path of travel onto the incline table surface. To this end, in the illustrated embodiment, each guide roller device 8 is disposed above each conveyor tape above the turn point 7 at the upstream tape roll 3 of the feed table. The guide roller devices 8 include a common support 10 which is fixed to a holder 11, the height and position of which can be selectively adjusted by any appropriate means. Each guide roller device 8 includes an L-shaped leg 10*a* of the support 10 which carries rows of deflection wheels 9 on opposite sides thereof. The axial spacing of the deflection wheels 9 is selected such that the contours of the selection wheels 9 somewhat overlap. This produces a quasi-continuous guide surface on the underside of the roller deflection wheels 9.

In carrying out the invention, the deflection wheels are arranged on the leg 10*a* of the support 10 in a curved arrangement to define a guide surface on the inlet side that is approximately tangential to the sheet feed plane from the sheet feeder and an outlet side that is approximately tangential to the surface of the feed table. The transition from the horizontal to the conveying plane of the sheet surface 7, as a result is curved by such arrangement of the deflection wheels.

It can be seen, with reference to the drawing, that a sheet horizontally directed from the sheet feeder will undergo a curved path of travel from the horizontal onto the inclined feed table surface, under the guidance of the deflection rollers 9. As a leading edge of the sheet reaches the conveyor tapes, preferably, suction vacuum is applied to the underside which grip and hold the sheets in contact with the small areas of the tapes.

In embodiment in which conveying rollers operate directly on the tape roll 3, the guide roller device 8 may be set with the deflection wheels 9 in relatively close relation to the surface of the feed table. The guiding action of the deflection rollers 9 will act upon the sheet B directly after it has emerged from the conveying rollers and the tape roll 3. In the alternative embodiment in which a conveying roll is mounted upstream, the guide roller device 8 may be positioned a greater distance from the tape roll 3 for reliably directing even relatively stiff sheets as they are guided onto the feet table.

From the foregoing, it can be seen that the sheet feed table of the present invention, through utilization of the selectively positionable curved array of deflection rollers, is operable for reliably processing a wide range of sheets, including very stiff sheets, to an incline sheet feed table for reliable onward transport.

What is claimed is:

1. A sheet feed table for receiving sheets directed from a sheet feeder along a substantially horizontal sheet feed plane and for transporting said sheets to a sheet processing machine, said sheet feed table having a sheet transfer table surface inclined at an angle with respect to the sheet feed plane, said sheet table being operative for receiving sheets from the sheet feeder and directing sheets downstream along the feed table surface, at least one guide roller device mounted above a turn point between the sheet feed plane and the feed table surface, said guide roller device comprising a plurality of deflection rollers arranged in a curved array which extends from a position approximately tangential to the sheet feed plane to a position approximately tangential to said table surface for directing the sheets along a curved path as defined by the deflection rollers onto the feed table surface.

2. The sheet feed table of claim 1 in which said deflection rollers are mounted for free rotation.

3. The sheet feed table of claim 1 in which said guide roller device includes a support, and said deflection rollers are mounted on the support one behind another in the conveying direction.

4. The sheet feed table of claim 3 in which said deflection rollers are fixed to the support on alternative sides and are arranged on said support such that the contours of deflection wheels on opposite sides of said support intersect.

5. The sheet feed table of claim 3 in which said support is mounted for selective positioning relative to said turn point.

6. The sheet feed table of claim 3 including a plurality of supports each having a plurality of deflector rollers mounted in a curved array, said supports being disposed at intervals along side one another transversely with respect to the conveying direction.

* * * * *